US006847159B2

(12) United States Patent
Suzuki et al.

(10) Patent No.: US 6,847,159 B2
(45) Date of Patent: Jan. 25, 2005

(54) PROJECTION TUBE HAVING DIFFERENT NECK DIAMETERS

(75) Inventors: Nobuyuki Suzuki, Oohara (JP); Kotaro Aoki, Mobara (JP); Kouichi Saitou, Chonan (JP); Shoji Shirai, Mobara (JP)

(73) Assignees: Hitachi Ltd., Tokyo (JP); Hitachi Electronic Devices, Co., Ltd., Chiba-ken (JP)

( * ) Notice: Subject to any disclaimer, the term of this patent is extended or adjusted under 35 U.S.C. 154(b) by 30 days.

(21) Appl. No.: 09/938,749

(22) Filed: Aug. 24, 2001

(65) Prior Publication Data

US 2003/0038583 A1 Feb. 27, 2003

(30) Foreign Application Priority Data

Jun. 8, 2001 (JP) ..... 2001-173408

(51) Int. Cl.[7] ..... H01J 29/86
(52) U.S. Cl. ..... 313/477 R; 313/426; 313/450
(58) Field of Search ..... 313/440, 450, 313/477 R, 478, 477 HC, 426, 460

(56) References Cited

U.S. PATENT DOCUMENTS

| | | | | |
|---|---|---|---|---|
| 2,250,622 A | | 7/1941 | Bowie | |
| 3,163,794 A | * | 12/1964 | Bloomsburgh et al. | 313/440 |
| 3,840,773 A | | 10/1974 | Hart | |
| 4,143,298 A | * | 3/1979 | Bing et al. | 313/450 |
| 5,777,430 A | | 7/1998 | Ueda et al. | |
| 5,909,079 A | | 6/1999 | Uchida et al. | |
| 5,994,830 A | | 11/1999 | Nose et al. | |
| 6,031,326 A | | 2/2000 | Suzuki et al. | |
| 6,133,685 A | | 10/2000 | Konda et al. | |
| 6,271,625 B1 | | 8/2001 | Van Engelshoven et al. | |
| 6,404,119 B1 | * | 6/2002 | Hidaka et al. | 313/477 R |
| 6,441,547 B1 | * | 8/2002 | Van Alphen et al. | 313/477 R |
| 2002/0180335 A1 | * | 12/2002 | Saitou et al. | 313/477 R |

FOREIGN PATENT DOCUMENTS

| | | | | |
|---|---|---|---|---|
| EP | 0 250 027 A1 | | 12/1997 | |
| JP | 58100344 | | 6/1983 | |
| JP | 03-192636 A | * | 8/1991 | 313/440 |
| JP | 11135037 | | 5/1999 | |
| JP | 11-185660 A | * | 7/1999 | H01J/29/51 |

OTHER PUBLICATIONS

J. Kilton; 52.4 : A 16–cm Large Neck Projection CRT for HDTV; SID 1999 Digest p. 1084–1087.

* cited by examiner

*Primary Examiner*—Ashok Patel
(74) *Attorney, Agent, or Firm*—Milbank, Tweed, Hadley & McCloy LLP

(57) ABSTRACT

The present invention aims at maintaining the high focusing performance with a low deflection power in a projection tube which is used as a projection type TV receiver or a projector and is operated at a high voltage and with a single-electron-beam high current. A neck outer diameter of a portion on which a deflection yoke is mounted is made smaller than a neck outer diameter of a portion which accommodates an electron gun. A final electrode of the electron gun has a diameter thereof gradually decreased toward a phosphor screen. The maximum anode voltage of the projection tube is set to equal to or more than 25 KV and the maximum beam current is set to equal to or more than 4 mA.

19 Claims, 9 Drawing Sheets

PROJECTION TUBE HAVING DIFFERENT NECK DIAMETERS

BACKGROUND OF THE INVENTION

1. Field of the Invention

The present invention relates to a projection tube which is used in a projection type TV receiver, a video projector or the like.

2. Description of the Related Art

An image of a cathode ray tube can be obtained by scanning an electron beam emitted from an electron gun by means of a deflection yoke. The deflection yoke is mounted in the vicinity of a joint portion between a neck and a funnel. The deflection sensitivity is enhanced as the neck outer diameter becomes smaller. However, when the neck outer diameter is made small to enhance the deflection sensitivity, the electron gun which is accommodated in the neck portion must be miniaturized correspondingly. When the electron gun is miniaturized, the diameter of an electron lens becomes small and hence, the focusing is degraded. That is, the deflection sensitivity and the focusing performance are in an opposed relationship.

A method which can solve such a problem is, for example, proposed in U.S. Pat. No. 3,163,794. In this Patent, there is disclosed a technique which enhances the deflection sensitivity by making the outer diameter of a portion of a neck of a cathode ray tube on which a deflection yoke is mounted smaller than the outer diameter of a portion of the neck in which an electron gun is accommodated. The maximum operating voltage of the cathode ray tube described in this patent is set to 16 kV.

However, such a cathode ray tube has not been commercialized yet. This is because that the maximum voltage is low so that an advantage obtained by the reduction of the deflection power is small. Further, since it is necessary to ensure a fixed dimension as the distance of the deflection yoke in the tube axis direction, when the outer diameter of a neck is set in two stages in an actual cathode ray tube, the position of an electron gun is usually made remoter from a phosphor screen due to mechanical restrictions. Accordingly, the total length of the cathode ray tube is elongated and hence, it gives rise to disadvantages such as the deterioration of the focusing performance as side effects.

On the other hand, with respect to a color cathode ray tube, in Japanese Laid-open Patent Publication 185660/1999, there is disclosed a technique which enhances the deflection sensitivity by making the outer diameter of a portion of a neck of a cathode ray tube on which a deflection yoke is mounted smaller than a portion of the neck in which an electron gun is accommodated.

However, such a cathode ray tube has not been also commercialized yet. The reason for such a circumstance is considered as follows. That is, although three electron beams which are arranged in an inline array are generated in the color cathode ray tube, since the electron beams at both sides approach an inner wall of a neck tube at a narrowed neck portion, there is a possibility that the electron beams impinge on the inner wall of the neck tube. Accordingly, it is difficult to take a large shrinkage rate of the neck diameter and hence, the deflection sensitivity enhancing effect becomes extremely small.

SUMMARY OF THE INVENTION

According to the present invention, in a cathode ray tube for a projection type TV receiver (PRT) which is operable at a high voltage of equal to or more than 25 kV, with a single electron beam and with a large current, the outer diameter of a neck at a portion on which a deflection yoke is mounted is made smaller than the outer diameter of the neck at a portion which accommodates an electron gun. Due to such a constitution, the reduction of the deflection power and the enhancement of the focusing performance can be achieved.

In the PRT, since (1) the cathode ray tube is operated at a high voltage, (2) scanning lines which are two to three times large in number compared to a usual TV set are used in many cases, (3) three PRTs are used in a projection type TV receiver and the like so that the advantage of reduction of the deflection power is remarkably large compared to the usual cathode ray tube.

Further, in the PRT, the improvement of the spherical aberration which occurs when the diameter of an electron lens is enlarged is more important than the improvement of the deterioration of focusing which occurs by the expansion of electron beams derived from the repulsion of the electron beams. That is, in the PRT, the influence which is generated by enlarging the diameter of the lens of the electron gun is more important than the influence which is generated when the electron gun becomes remote from a phosphor screen by differing the neck diameter.

Accordingly, the advantages of the present invention which adopts the constitution of the PRT as the constitutional features are extremely large.

In the electron gun of the present invention, to prevent the distance between a phosphor screen and a main lens of the electron gun from becoming large, a final electrode of the electron gun is constituted of a large-diameter cylindrical portion, a small-diameter portion and a portion which gradually decreases a diameter thereof, the large-diameter portion of the final electrode is mounted in a large-diameter portion of a neck and the small-diameter portion of the final electrode is provided to a small-diameter portion of the neck.

DESCRIPTION OF THE PREFERRED EMBODIMENTS

An embodiment of a projection tube having different neck diameters according to the present invention is explained hereinafter in conjunction with attached drawings.

Figure 1:
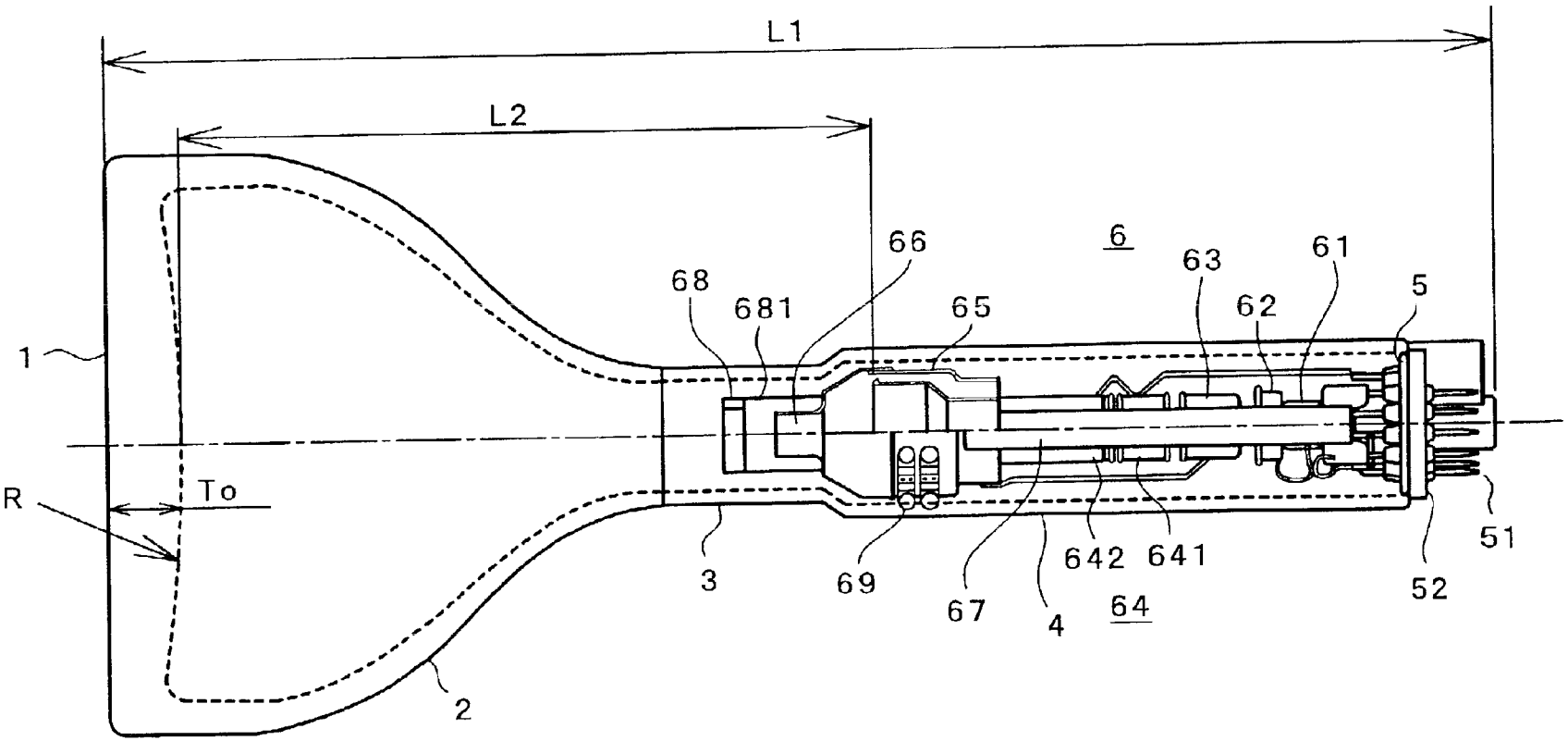
FIG. 1 is a cross-sectional view of a PRT of the present invention.

FIG. 1 is a schematic cross-sectional view of a cathode ray tube for a projection type TV receiver (PRT) of the present invention. A monochromatic image is formed in the PRT. Only one electron beam is used. A phosphor screen is formed on an inner side of a panel 1. The panel 1 has a flat outer surface and an inner surface which is bulged toward an electron gun side. With such a provision, a convex lens is formed. In this embodiment, the inner surface of the panel 1 is formed in a spherical face having a radius R of curvature of 350 mm. To reduce the aberration, the inner surface may be formed in a non-spherical face. The thickness T0 of the panel 1 at the center thereof is 14.1 mm. The profile size of the panel 1 in the diagonal direction is set to 7 inches and the effective diagonal diameter which allows the formation of image is set to 5.5 inches. The total length L1 of the PRT is set to 276 mm. A funnel 2 connects a neck portion 3 and the panel 1.

The outer diameter of the neck portion 3 is set to 29.1 mm. The outer diameter of a neck portion 4 which accommodates the electron gun is set larger than the outer diameter of the neck portion 3 and is set to 36.5 mm. Here, 29.1 mm and 36.5 mm which indicate the neck outer diameters mean substantial numerical values which are set in consideration of errors in manufacturing necks. A deflection yoke which deflects an electron beam is mounted on the neck portion 3 which has the small diameter. Due to such a constitution, the deflection power can be suppressed as small as possible. In this case, the deflection power can be reduced by approximately 25% compared with a case in which the neck outer diameter is set to 36.5 mm.

Since an electron gun 6 is accommodated in the neck portion 4 which has the large diameter, the diameter of an electron lens can be made large. A first grid 61 of the electron gun 6 has a cup-like shape and a cathode which emits the electron beam is accommodated in the first grid 61. An accelerating electrode 62 forms a prefocus lens together with the first anode 63. An anode voltage of 30 kV which is a voltage applied to a second anode 65 which constitutes a final electrode is also applied to a first anode 63. In general, the anode voltage applied to the PRT is equal to or more than 25 kV.

By making the neck outer diameters different, the electron gun 6 is positioned remote from a phosphor surface due to mechanical restrictions. When the electron gun 6 is positioned remote from the phosphor screen, the focusing is deteriorated. However, in the PRT, by rising the voltage to a high voltage, the PRT can easily cope with the problem concerned with the deterioration of focusing. The PRT can be operated at the maximum voltage of equal to or more than 30 kV.

A focus electrode 64 is divided into a focus electrode 641 and a focus electrode 642, wherein a focus voltage of approximately 8 kV is applied to both focus electrodes 641, 642. The distance L2 between a distal end of the focus electrode 642 and the inner surface of the panel 1 is set to 139.7 mm. The focus electrode 642 enlarges the diameter thereof at the phosphor screen side thereof and forms a large diameter main lens together with the second anode 65. This main lens can be made larger corresponding to the increase of the neck outer diameter.

Since the PRT requires a high brightness, a beam current (a cathode current) becomes equal to or more than 4 mA. To maintain the high focusing performance even with such a large current, it is extremely important that the diameter of the main lens can be increased. In the PRT, since the voltage on the phosphor screen is high, the expansion of the beam derived from the repulsion of space charge particularly at the time of supplying a large current becomes relatively small and the size of the electron beam spot on the phosphor screen at the time of supplying a large current is substantially determined by the expansion of the beam due to the spherical aberration of the electron gun.

A shield cup 66 integrally forms a final lens together with the second anode 65. The diameter of the phosphor screen side of the shield cup 66 is gradually made small. Corresponding to the constitution that the neck outer diameter becomes small in the vicinity of the distal end of the electron gun, the diameter of the electron gun in the vicinity of the distal end thereof is also made small thus preventing the electron gun from being positioned far remote from the phosphor screen.

Respective electrodes are fixedly secured by means of a bead glass 67. The phosphor screen side of the shield cup 66 has the outer diameter thereof made considerably smaller than that of the second anode 65. This provision is provided to prevent the deterioration of the withstand voltage which is caused by the adhesion of getter for enhancing the degree of vacuum in the inside of the PRT to the electrode. A ring-shaped getter 68 is connected to the shield cup 66 by means of a getter support 681.

Figure 2:
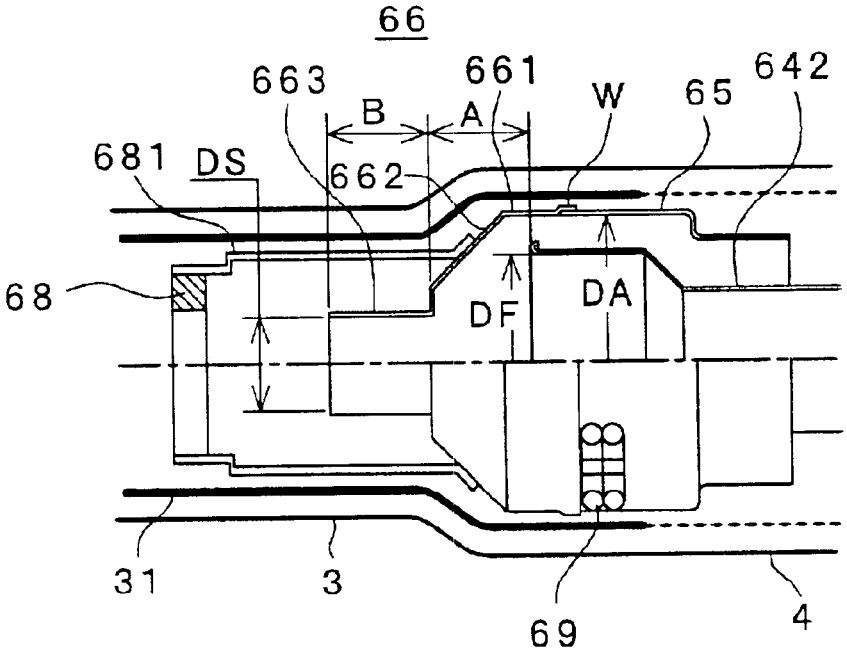
FIG. 2 is a first embodiment of a main lens portion.

FIG. 2 is a detailed view of a first embodiment of the electron gun in the vicinity of the main lens. The second anode 65 and the shield cup 66 overlap each other at a portion W thus forming a final electrode. An inner diameter DA of the second anode 65 is set to 27.8 mm which is substantially equal to the inner diameter of a large-diameter portion 661 of the shield cup 66. The focus electrode 642 enters the inside of the second anode 65 thus forming a large-diameter electron lens. An inner diameter DF of a distal end portion of the focus electrode 642 is set to 20.5 mm.

In this embodiment, the main lens is substantially formed of the large-diameter portion 661 of the shield cup 66 and the focus electrode 642. An inner diameter DS of a small-diameter portion 663 of the shield cup 66 is set to 9 mm. This provision is provided to prevent the deterioration of the withstand voltage which occurs due to the adhesion of the getter 68 to the focus electrode 642 or the like by a backlash when the getter 68 is scattered for enhancing the degree of vacuum. An inner diameter of a distal end of the shield cup 66 is set to 9 mm. An axial distance A from the distal end of the focus electrode 642 to the rear end of the small-diameter portion 663 of the shield cup 66 is set to 10 mm and an axial length B of the small-diameter portion 663 of the shield cup 66 is set to 10 mm.

A bulb spacer contact 69 has a role to keep a proper distance between an inner wall of the neck portion 4 and the electron gun 6 and a role to supply a high voltage to the final electrode. In this embodiment, the bulb spacer contact 69 is mounted at a position corresponding to the neck diameter of 36.5 mm. In this case, a neck graphite 31 is formed such that the neck graphite 31 is extended to a position which allows the sufficient electric contact between the neck graphite 31 and the bulb spacer contact 69.

Figure 3:
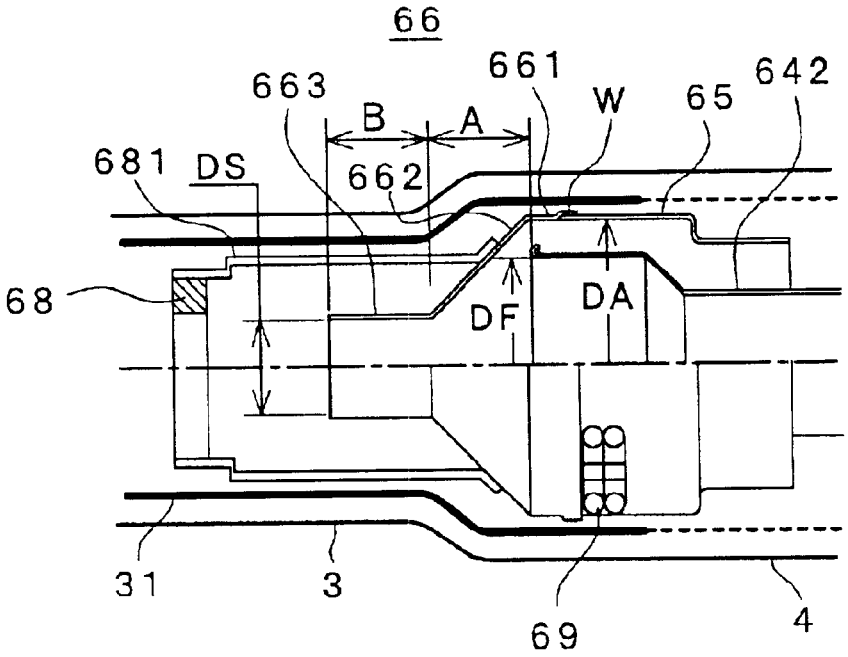
FIG. 3 is a second embodiment of the main lens portion.

FIG. 3 shows a second embodiment of the electron gun in the vicinity of the main lens. The constitution shown in FIG. 3 differs from the constitution of FIG. 2 in that a transition portion 662 from the large-diameter portion 661 to the small-diameter portion 663 of the shield cup 66 is not stepped but is formed in a straight line. This embodiment is characterized in that the electron gun can be positioned closer to the phosphor screen side by an amount obtained by forming the straight transition portion 662.

Figure 4:
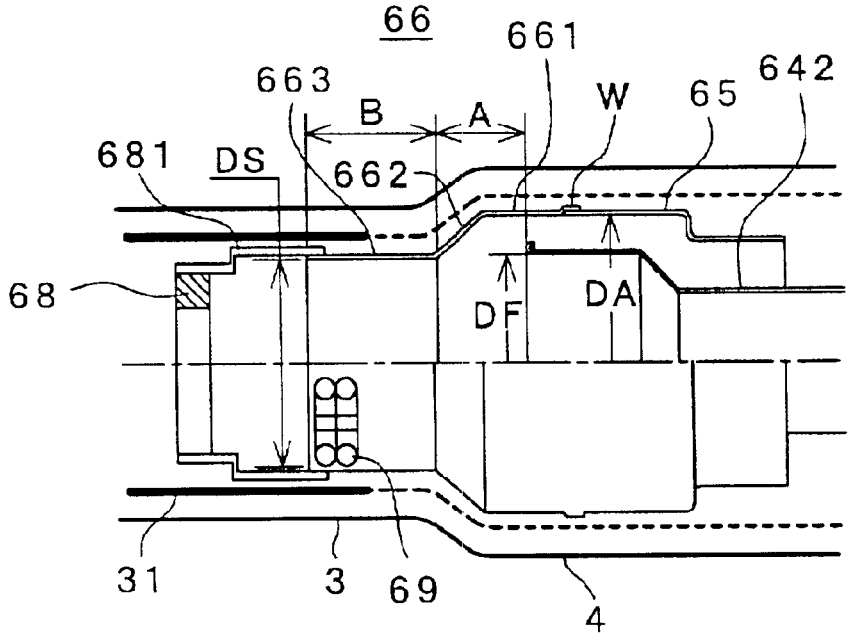
FIG. 4 is a third embodiment of the main lens portion.

FIG. 4 shows a third embodiment of the electron gun in the vicinity of the main lens. In the third embodiment, the bulb spacer contact 69 is mounted on the small-diameter portion 663 of the shield cup 66 and is brought into contact with an inner wall of the small-diameter portion 3 of the neck. In this case, it is sufficient to coat the neck graphite 31 only onto the inner wall of the small-diameter portion 3 of the neck. The productivity and the reliability can be enhanced by an amount obtained by making the extension of the neck graphite to the large-diameter portion 4 of the neck unnecessary. The axial distance A from the distal end of the focus electrode 642 to the rear end of the small-diameter portion 663 of the shield cup 66 is set to 6 mm and the axial length B of the small-diameter portion 663 of the shield cup 66 is set to 14 mm. The diameter DS of the distal end of the shield cup 66 is set to 21 mm.

Figure 5:
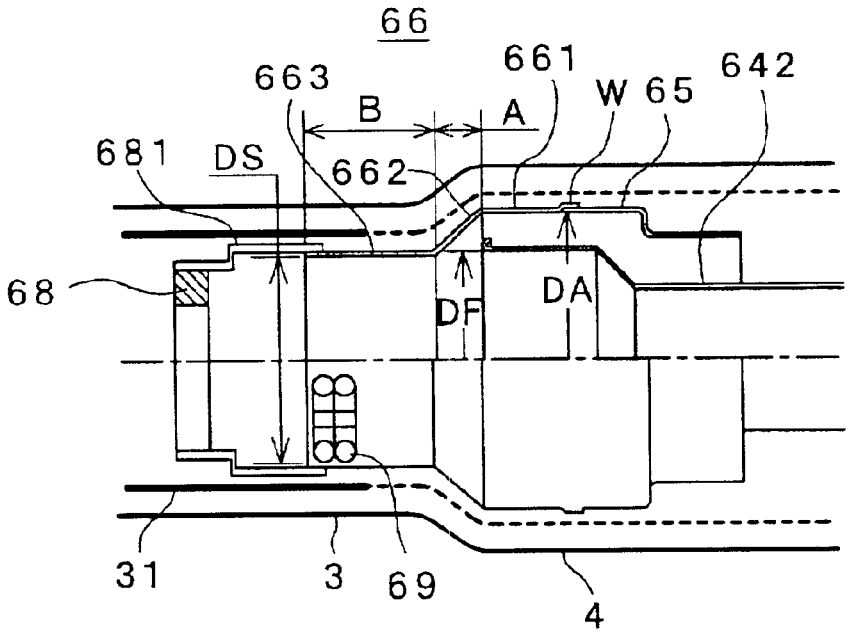
FIG. 5 is a fourth embodiment of the main lens portion.

FIG. 5 shows a fourth embodiment of the electron gun in the vicinity of the main lens. Except for the constitutional features that the axial distance A from the distal end of the focus electrode 642 to the rear end of the small-diameter portion 663 of the shield cup 66 is set to 3 mm and the axial length B of the small-diameter portion 663 of the shield cup 66 is set to 17 mm, the constitution of the fourth embodiment is substantially equal to the constitution of the third embodiment. In this embodiment, the position of the main lens can be made closer to the phosphor screen by an amount that the focus electrode 641 can approach the small-diameter portion 663 of the shield cup 66. Dimensions other than the above-mentioned dimensions are as same as the corresponding dimensions of the third embodiment. The fourth embodiment has the same axial distance A from the distal end of the focus electrode 642 to the distal end of the small-diameter portion 663 of the shield cup 66 as that of the third embodiment. With respect to the structures of the third embodiment and the fourth embodiment, to prevent the disturbance of the electric field of the main lens, it is preferable to set the distance from the distal end of the focus electrode 641 to the distal end of the small-diameter portion 663 of the shield cup 66 to equal to or more than 20 mm.

Figure 6:
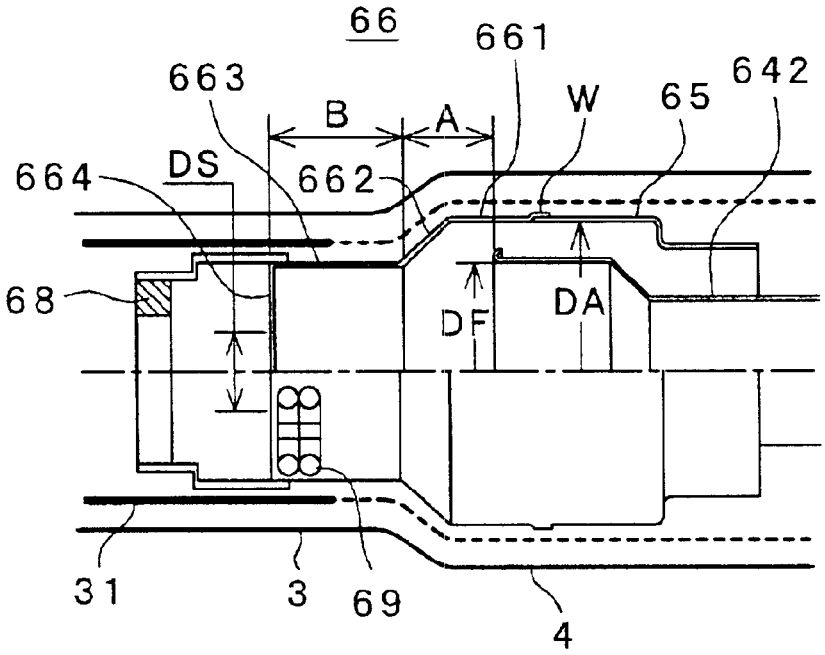
FIG. 6 is a fifth embodiment of the main lens portion.

FIG. 6 shows a fifth embodiment of the electron gun in the vicinity of the main lens. Except for the constitutional feature that a flange 664 is formed on the distal end of the shield cup 66 and the bore diameter of the distal end thereof is set to 9 mm, the fifth embodiment has the same constitution as that of the third embodiment. In this embodiment, since the bore diameter of the distal end of the shield cup 66 is small, compared to the third embodiment, the influence derived from the backflash of the getter can be decreased.

Figure 7:
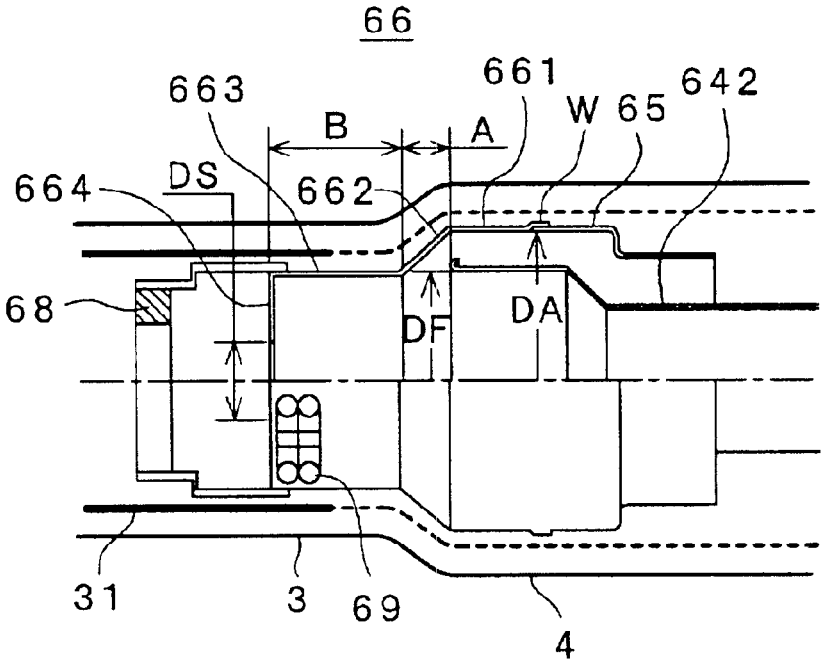
FIG. 7 is a sixth embodiment of the main lens portion.

FIG. 7 shows a sixth embodiment of the electron gun in the vicinity of the main lens. Except for the constitutional feature that a flange 664 is formed on the distal end of the shield cup 66 and the bore diameter of the distal end thereof is set to 9 mm, the sixth embodiment has the same constitution as that of the fourth embodiment. In this embodiment, since the bore diameter of the distal end of the shield cup 66 is small, compared to the fourth embodiment, the influence derived from the backflash of the getter can be decreased.

Figure 8:
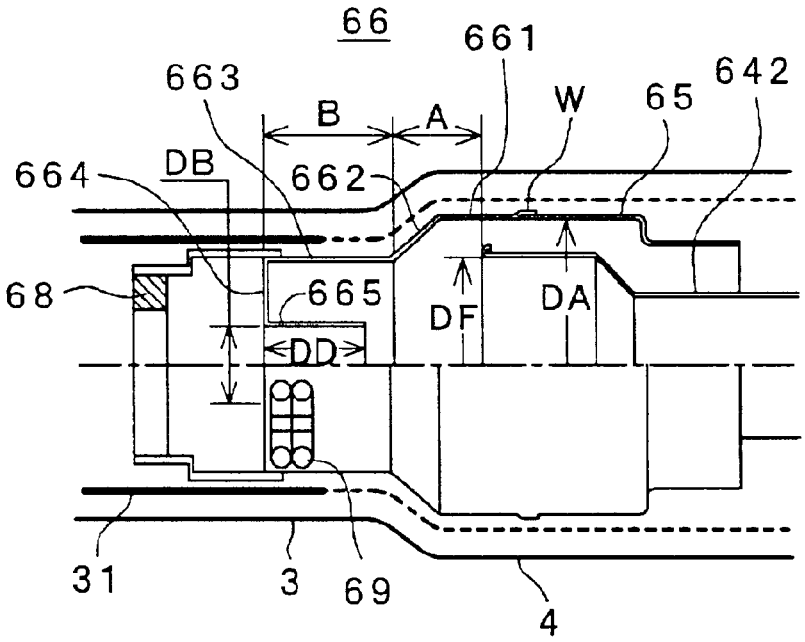
FIG. 8 is a seventh embodiment of the main lens portion.

FIG. 8 shows a seventh embodiment of the electron gun in the vicinity of the main lens. A cylindrical burring 665 is formed on the distal end of the shield cup 66 such that the burring 665 is extended in the direction toward the focus electrode 632. An inner diameter DB of the burring 665 is set to 9 mm and a depth DD of the burring 665 is set to 10 mm. With the provision of this burring 665, the influence derived from the backflash of the getter can be also reduced. Dimensions other than the above-mentioned dimensions are as same as the corresponding dimensions of the fifth embodiment.

Figure 9:
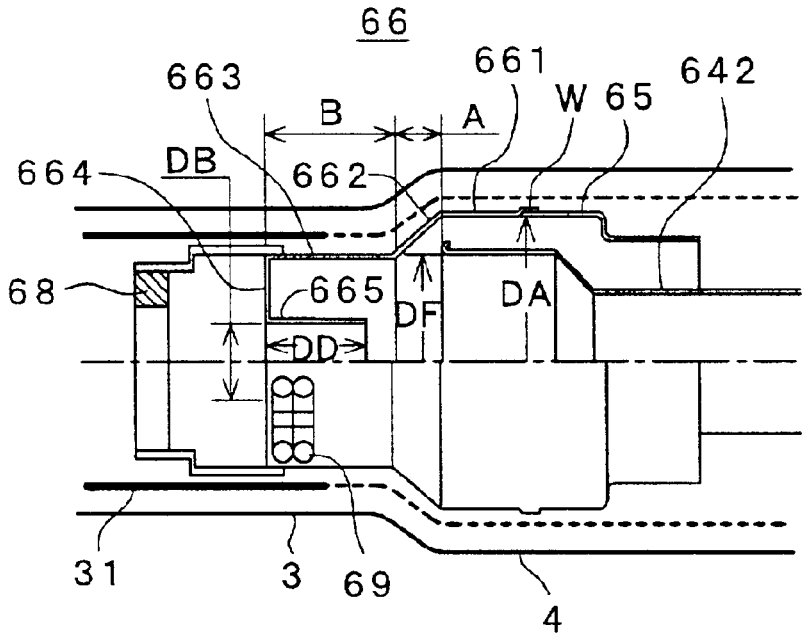
FIG. 9 is an eighth embodiment of the main lens portion.

FIG. 9 shows an eighth embodiment of the electron gun in the vicinity of the main lens. A cylindrical burring 665 is formed on the distal end of the shield cup 66 such that the burring 665 is extended in the direction toward the focus electrode 632. An inner diameter DB of the burring 665 is set to 9 mm and a depth DD of the burring 665 is set to 10 mm. With the provision of this burring 665, the influence derived from the backlash of the getter can be also reduced. Dimensions other than the above-mentioned dimensions are as same as the corresponding dimensions of the sixth embodiment.

Figure 10:
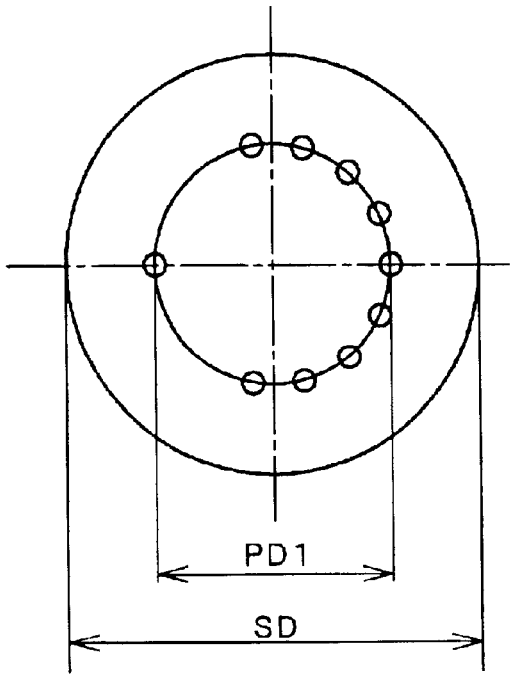
FIG. 10 is a plan view showing a stem portion of the PRT of the present invention.

The stem 5 is provided with pins 51 for supplying voltages to respective electrodes of the electron gun. A base 52 protects this stem 5 and the pins 51. FIG. 10 is a plan view of the stem portion according to this embodiment. The stem outer diameter SD is set to 28.3 mm and corresponds to the neck outer diameter 36.5 mm. The feature of this embodiment lies in that although the stem outer diameter corresponds to the neck outer diameter 36.5 mm, the pin circle diameter PD1 is set to 15.12 mm which is the diameter corresponding to the neck outer diameter of 29.1 mm. Here, 15.12 mm is a substantial value which is set by taking also the manufacturing error into consideration.

Figure 11:
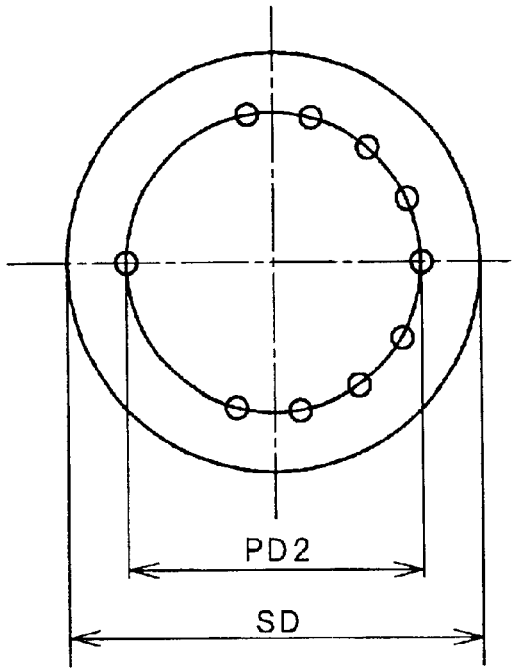
FIG. 11 is a plan view showing a stem portion in case of a usual 36.5 mm neck.

For a comparison purpose, a plan view of a usual stem portion when the neck outer diameter is set to 36.5 mm is shown in FIG. 11. The stem outer diameter SD is set to 28.3 mm and the pin circle diameter PD2 is set to 20.32 mm. It is a usual design to increase the pin circle diameter corresponding to the increase of the neck outer diameter. It is because that the larger becomes the pin circle diameter, the distance between respective pins becomes larger and hence, it is advantageous for the withstand voltage.

However, in this embodiment, the reason that while the neck outer diameter is set to 36.5 mm, the diameter of the pin circle is set to a diameter equal to the diameter of the pin circle when the neck outer diameter is set to 29.1 mm is as follows. That is, a portion of a deflection circuit is connected to the pins 51. Since a deflection yoke which corresponds to the neck outer diameter of 29.1 mm is used, by setting the diameter of the pin circle to a value which is equal to the diameter of the pin circle when the neck diameter is set to 29.1 mm, a circuit board which is equal to a circuit board when the neck outer diameter is 29.1 mm can be used. Further, as the connector, a connector for the neck outer diameter of 29.1 mm which has high generality can be used.

Figure 12:
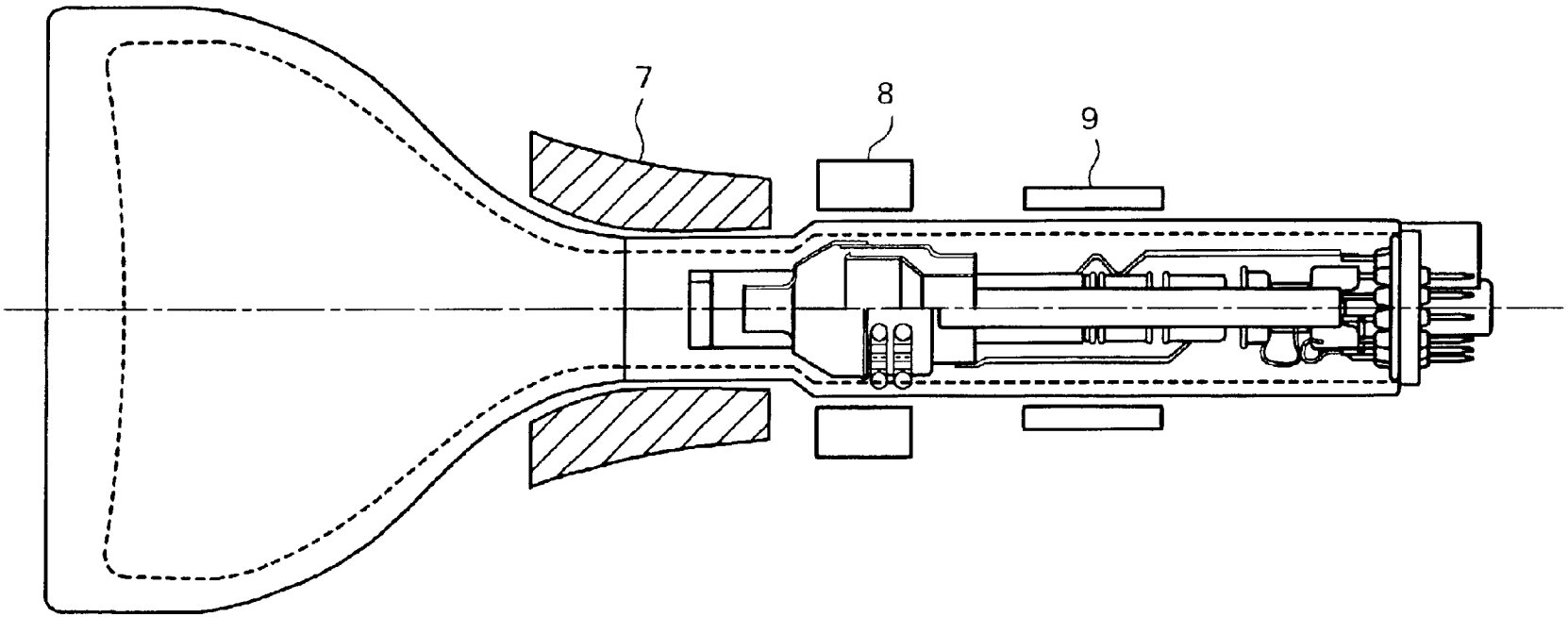
FIG. 12 is a schematic view showing a constitution in which a deflection yoke, a convergence yoke and a velocity modulation coil are mounted on the PRT of the present invention.

FIG. 12 is a schematic view showing a constitution in which a deflection yoke 7, a convergence yoke 8 and a velocity modulation coil 9 are mounted on the PRT of the present invention. The deflection yoke 7 is mounted on the neck portion 3 having the small diameter. The convergence yoke 8 is mounted on the neck portion 4 having the large diameter. The reason that the convergence yoke 8 is mounted on the neck portion 4 having the large diameter lies in the prevention of the excessive elongation of the total length of the PRT.

By allowing the total length of the PRT to be elongated and mounting the convergence yoke 8 on the neck portion 3 having the small diameter, the sensitivity of the convergence yoke 8 can be enhanced. Further, the integration of the deflection yoke 7 and the convergence yoke 8 can be facilitated.

Figure 13:
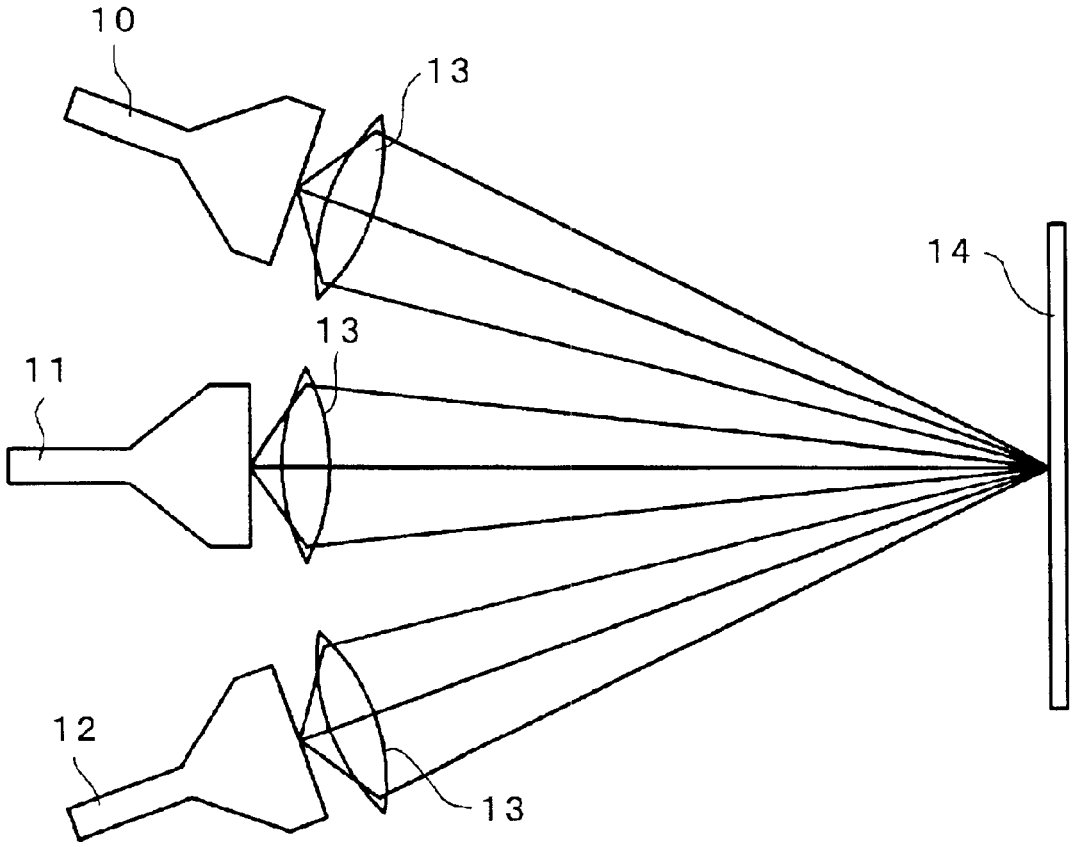
FIG. 13 is a conceptual view of a projection type TV receiver in a planar constitution.

As shown in FIG. 13, in a projection type TV receiver, images projected from three PRTs consisting of a red PRT 10, a green PRT 11 and a blue PRT 12 are converged on a screen 14 after passing through lenses 13 so as to form a projected image. Although the convergence is performed by inclining respective PRTs relative to each other, the fine adjustment is performed by the convergence yokes 8 mounted on the respective PRTs.

The velocity modulation coil 9 is served for enhancing the contrast of the image. Since the velocity modulation coil 9 is mounted on the portion having the neck outer diameter of 36.5 mm, the sensitivity becomes a problem. For enhancing the sensitivity of the velocity modulation coil 9, the focus electrode 64 is divided into the electrode 641 and the electrode 642 and a gap is formed between the electrode 641 and the electrode 642 so as to facilitate the application of the magnetic field of the velocity modulation coil 9 to the electron beams.

Figure 14:
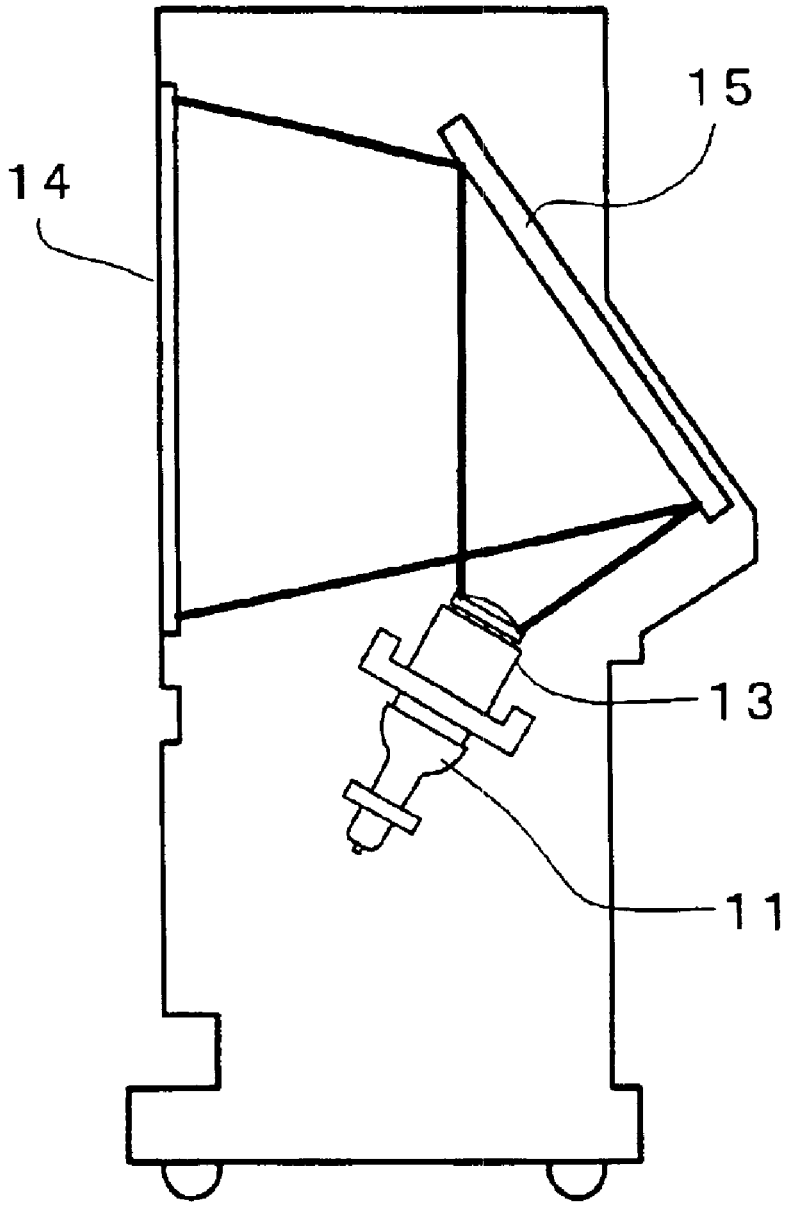
FIG. 14 is schematic longitudinal cross-sectional view of the projection type TV receiver.

FIG. 14 is a schematic cross-sectional view of the projection type TV receiver. The image projected from the PRT 11 passes through the lens 13, is reflected on a mirror 15 and then is projected onto the screen 14. As shown in FIG. 6, the total length of the PRT does not directly influence the depth of the projection type TV receiver.

Further, since the projection type TV receiver uses three PRTs, the projection type TV receiver exhibits the deflection power saving effect which is three times higher than that of a usual TV set. Further, the projection type TV receiver usually has a large screen of a screen diagonal size of equal to or more than 40 inches. In such a large screen, scanning lines become apparent thus deteriorating the image quality when usual NTSC signals are used. To prevent this phenomenon, in the projection type TV receiver, the ADVANCED TV method which has a large number of scanning lines is adopted in many cases. In this case, the number of scanning lines becomes two to three times larger than that of the usual NTSC method so that the deflection power is increased. Accordingly, with the use of the PRT according to the present invention, an extremely large deflection power saving effect can be obtained in the projection type TV receiver.

The present invention is applicable not only to the projection type TV receiver but also to a general projector which uses three PRTs.

What is claimed is:

1. A projection tube comprising a panel having a phosphor screen on an inner surface thereof, a funnel, a neck portion, and a stem portion which seals the neck portion, wherein:

the neck portion includes a first neck portion which constitutes a portion connected to the funnel and has a first outer diameter of the neck portion, and a second neck portion which accomodates an electron gun which emits a single electron beam toward the phosphor screen and has a second outer diameter of the neck portion, the first outer diameter of the neck portion is set smaller than the second outer diameter of the neck portion, the electron gun includes a main lens which is constituted of a final electrode and a focus electrode which has portion thereof inserted into the inside of the final electrode, the final electrode has a large-diameter portion and a portion whose diameter is gradually decreased toward the phosphor screen, and a high voltage is applied to the final electrode is set to equal to or more than 25 KV.

2. A projection tube according to claim 1, wherein the second outer diameter of the neck portion is set to equal to or more than 36.5 mm.

3. A projection tube according to claim 1 wherein said final electrode is constituted of a second anode and a shield cup.

4. A projection tube according to claim 3, wherein the second outer diameter of the neck portion is set to equal to or more than 36.5 mm.

5. A projection tube according to claim 3, wherein an inner diameter of the shield cup is gradually decreased toward the phosphor screen.

6. A projection tube according to claim 5, wherein the second outer diameter of the neck portion is set to equal to or more than 36.5 mm.

7. A projection tube according to claim 3, wherein the shield cup includes a large-diameter portion and a small-diameter portion and main lens is constituted of the large-diameter portion of the shield cup and the focus electrode.

8. A projection tube according to claim 7, wherein the second outer diameter of the neck portion is set to equal to or more than 36.5 mm.

9. A projection tube according to claim 1, wherein a neck graphite for supplying the high voltage is formed on an inner wall of the first neck portion and an inner wall of the second neck portion, and a bulb spacer contract which electrically connects the neck graphite and the final electrode is mounted on the large-diameter portion of the final electrode.

10. A projection tube according to claim 9, wherein the bulb spacer contract is mounted on the second anode.

11. A projection tube according to claim 1 wherein the first outer diameter of the neck portion is set to equal to or less than 29.1 mm.

12. A projection tube according to claim 1, wherein the first outer diameter of the neck portion is set to 29.1 mm and the second outer diameter of the neck portion is set to 36.5 mm.

13. A projection tube according to claim 1, wherein the high voltage is set to 30 kV or more.

14. A projection tube comprising a panel having a phosphor screen on an inner surface thereof a funnel, a neck portion and a stem portion which seals the neck portion, wherein:

the neck portion includes a first neck portion which constitutes a portion connected to the funnel and has a first outer diameter of the neck portion, and a second neck portion which has a second outer diameter of the neck portion, the first outer diameter of the neck portion is set smaller than the second outer diameter of the neck portion, a main lens portion of an electron gun which generates a single electron beam is disposed in the second neck portion, the main lens is constituted of a final electrode and a focus electrode which has a portion thereof inserted into the inside of the final electrode, the final electrode includes a large-diameter cylindrical portion which constitutes a portion in which the focus electrode is inserted, a small-diameter cylindrical portion of the phosphor screen side and a portion whose diameter is gradually decreased toward the phosphor screen, and a high voltage applied to the final electrode is set to equal to or more than 25 KV.

15. A projection tube according to claim 14, wherein the small diameter cylindrical portion of the final electrode is disposed in the inside of the first neck portion.

16. A projection tube according to claim 14 wherein a neck graphite which supplies the high voltage is formed on an inner wall of the first neck portion and a bulb spacer contact which electronically connects the neck graphite and the final electrode is mounted on the small-diameter cylindrical portion of the final electrode.

17. A projection tube according to claim 14, wherein the neck graphite is not provided to an inner wall of the second neck portion.

18. A projection tube according to claim 14 wherein a flange defining a diameter which is further smaller than an inner diameter of the small-diameter cylindrical portion is formed on a phosphor-screen-side end of the small-diameter portion of the final electrode.

19. A projection tube according to claim 14, wherein a cylindrical burring is formed on the inner side of the small-diameter cylindrical portion of the final electrode such that the cylindrical burring is extended from a phosphor-screen-side end portion toward of focus electrode side.

* * * * *